United States Patent [19]

De Lorenzo

[11] 4,157,114

[45] Jun. 5, 1979

[54] TUBESHEET WITH A THERMAL SLEEVE

[76] Inventor: John F. De Lorenzo, 90 Mountain Ave., North Caldwell, N.J. 07006

[21] Appl. No.: 826,314

[22] Filed: Aug. 22, 1977

[51] Int. Cl.[2] ..... F28F 9/02

[52] U.S. Cl. ..... 165/158; 165/176

[58] Field of Search ..... 122/32; 165/81, 82, 165/158, 161, 176

[56] References Cited

U.S. PATENT DOCUMENTS

| | | | |
|---|---|---|---|
| 971,394 | 9/1910 | Morris | 122/32 |
| 2,523,174 | 9/1950 | Worn | 165/161 X |
| 3,258,068 | 6/1966 | Hollister | 165/158 |
| 3,982,585 | 9/1976 | Gribsuad | 165/158 X |

*Primary Examiner*—Samuel Scott
*Assistant Examiner*—Theophil W. Streule, Jr.
*Attorney, Agent, or Firm*—Norman N. Popper; Daniel H. Bobis

[57] ABSTRACT

A tubesheet in which an integral annular concentric support formed on a tubular rim, holds a tube plate in spaced relation to the rim, so as to allow the support to deflect during transient temperature and pressure changes without becoming overstressed.

6 Claims, 4 Drawing Figures

TUBESHEET WITH A THERMAL SLEEVE

BACKGROUND OF THE INVENTION

1. Field of Invention

This invention relates generally to heat exchangers, and particularly to tubesheets wherein a bundle of tubes are arranged so that heat can be transferred to or from the surrounding medium.

2. Prior Art

In devices designed to exchange heat between two fluids, wherein one of the fluids is caused to flow through a bundle of tubes surrounded by the second fluid, the tubesheets space and support the tubes. The tubesheet (or tubesheets) may be subject to fatigue failure caused by temperature changes of the fluids. Rapid changes in the tubeside fluid temperature have been demonstrated to cause large thermal stresses at the junction of the tube plate and tubesheet rim caused by the radial restraint of the tubesheet rim. These alternating thermal stresses can result in a fatigue failure and malfunction of the heat exchanger.

SUMMARY OF INVENTION

It was discovered that if instead of connecting the tube plate directly to the tube rim, it rather should be mounted on an integral support formed by providing an annular space between the central portion of the tube sheet, and the tube sheet rim. In this manner, the restraint to radial growth and shrinkage of the central portion of the tubesheet can be significantly reduced. The thermal stresses and the possibility of fatigue failure caused by this restraint are reduced. The reduced restraint is caused by the flexibility of the tubesheet support when compared to the flexibility of the usual tubesheet rim. Further, the annular space allows more uniform tubesheet temperature and lower thermal stresses.

THE DRAWINGS

These objects and advantages as well as other objects and advantages may be obtained by the construction shown by way of illustration in the drawings in which.

PREFERRED EMBODIMENT

Figure 1:
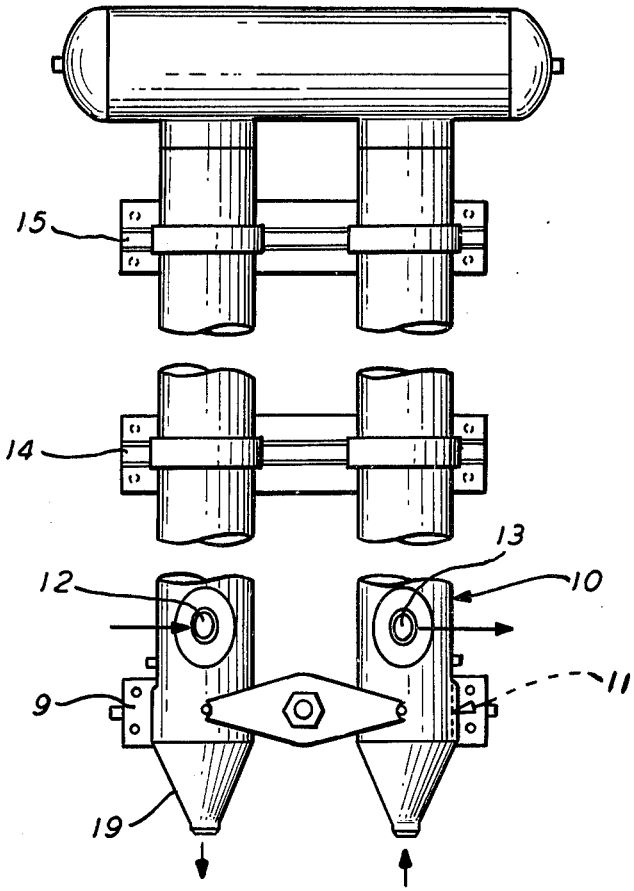
FIG. 1 is a view of a heat exchanger assembly.

Referring now to the drawings in detail, the shell 10 assembly provides an intake port 12 and an exhaust port 13 for introducing a heat exchange liquid and discharging it on the shell side or outside the tubes. Typical mounting means 9, 14 and 15 are shown by way of illustration.

Figure 2:
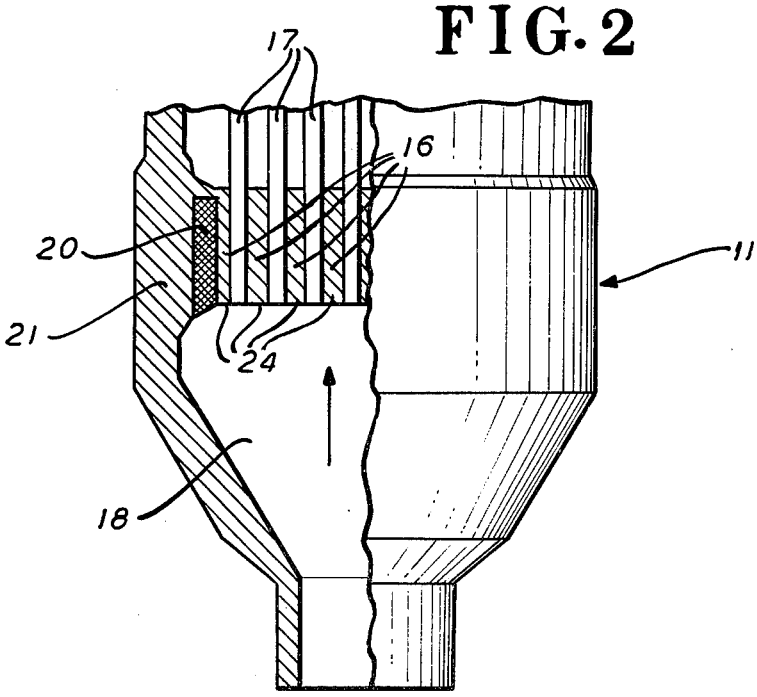
FIG. 2 is a partial sectional view of a conventional tubesheet showing the overstress area cross hatched.
Figure 3:
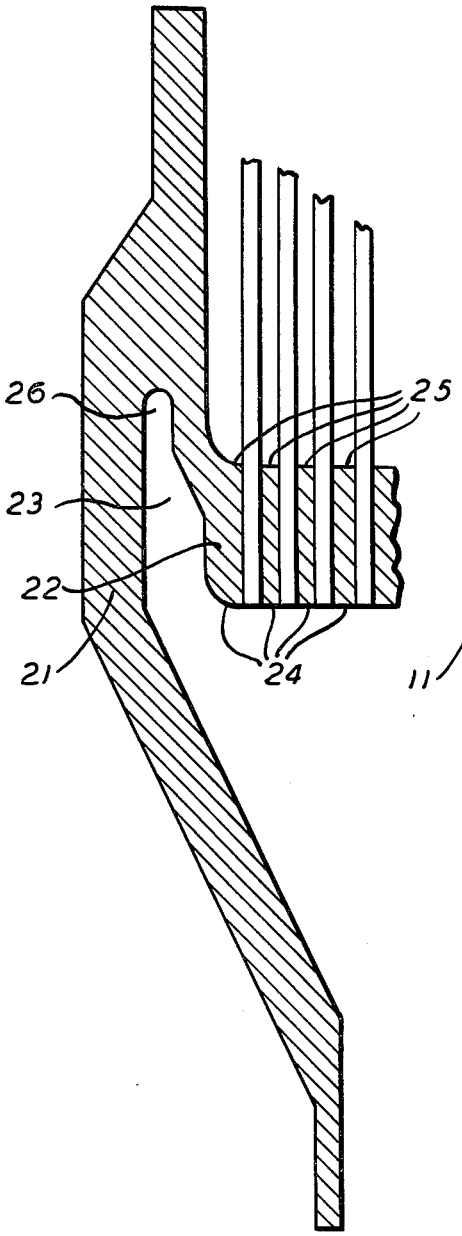
FIG. 3 is a vertical sectional half-view of a conventional tubesheet modified to provide an annular space between the tube plate and the tube rim.
Figure 4:
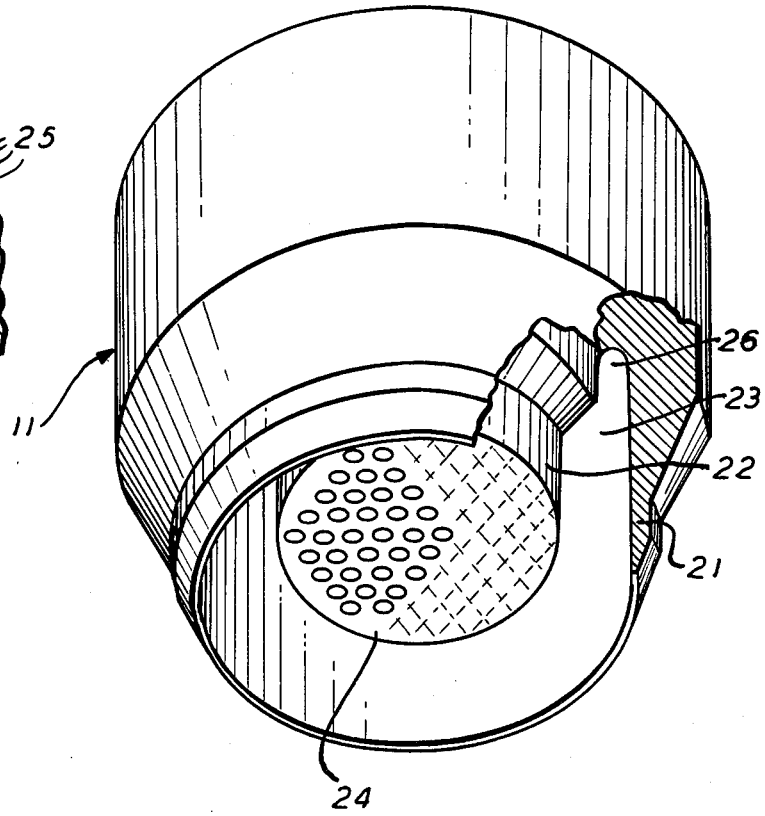
FIG. 4 is a perspective view of a thermal sleeve tubesheet partially sectioned.

FIG. 2 illustrates the portion of the tubesheet 11 wherein the tube plate 16 is affixed. Numerous tubes 17 issue from the tube plate 16, and received tube side fluid from a power plant, or the like. The fluid, which may be at very high temperature, enters the chamber 18 and passes through the tube plate 16 into the tubes 17. The tubes 17 are bathed in the heat exchanger medium entering and leaving the shell at the ports 12 and 13. A similar tube plate 16 and chamber 18 are found at the discharge end 19 of the exchanger. In FIG. 2 careful analysis found that the greatest thermal stress area 20 lay between the tube sheet rim 21 and the tube plate 16.

A tubesheet 11 was prepared with the tube plate 16 mounted on an annular support 22, (the thermal sleeve) with an annular space 23 defined between the support 22 and the support rim 21. The annular space 23 extended from the dorsal face 24 of the tube plate 16, not only to the opposite ventral face 25 but even a space 26 beyond the tube plate. By this means, the differential expansion and contraction of the tube plate 16 is not communicated directly to the tubesheet rim 21 but is exerted on the annular support 22 which may be deflected into the annular space 23 without overstressing the tubesheet rim 21.

What is claimed is:

1. A tubesheet with a thermal sleeve comprising,
a. a tubular rim,
b. an integral annular concentric support on the inside of the rim and the support defining an annular space,
c. an integral tube plate on the support transverse to the rim,
d. the support forming an integral connection for the tube plate with said tubulation,
e. the tube plate having a ventral face and a dorsal face,
f. the longitudinal depths of the annular space extending beyond the dorsal and the ventral faces of the tube plate,
g. the dorsal and ventral faces of the tube plate being generally opposite the annular space,
h. the annular space between the rim and the support communicating with the dorsal face of the tube plate.

2. A tubesheet with a thermal sleeve comprising,
a. the device according to claim 1, and
b. the annular space extending beyond the ventral face of the tube plate.

3. A tubesheet with a thermal sleeve comprising,
a. the device according to claim 1, and
b. a flared chamber at the dorsal face of the tube plate.

4. A tubesheet with a thermal sleeve comprising,
a. the device according to claim 1, and
b. the integral annular concentric support attached to inside of the rim on the ventral side of the tube plate and extending in the direction of the dorsal side of the tube plate.

5. A tubesheet with a thermal sleeve comprising,
a. the device according to claim 1, and
b. the integral annular concentric support attached to the inside of the rim beyond the ventral side of the tube plate and extending therefrom beyond the dorsal side of the tube plate.

6. A tubesheet with a thermal sleeve comprising,
a. the device according to claim 1, and
b. the annular space between the inside of the rim and the integral annular concentric support, extending at one end from beyond the ventral face and on the other end to a point beyond the dorsal face of the tube plate.

* * * * *